US009302146B1

(12) United States Patent
Wien

(10) Patent No.: US 9,302,146 B1
(45) Date of Patent: Apr. 5, 2016

(54) JUMPER 360

(71) Applicant: Abraham Wien, Boca Raton, FL (US)

(72) Inventor: Abraham Wien, Boca Raton, FL (US)

( * ) Notice: Subject to any disclaimer, the term of this patent is extended or adjusted under 35 U.S.C. 154(b) by 321 days.

(21) Appl. No.: 14/046,938

(22) Filed: Oct. 5, 2013

(51) Int. Cl.
*A63B 21/00* (2006.01)
*A63B 22/00* (2006.01)

(52) U.S. Cl.
CPC ..... *A63B 22/0087* (2013.01)

(58) Field of Classification Search
CPC ..... A63B 21/00
USPC ..... 482/66, 69
See application file for complete search history.

(56) References Cited

U.S. PATENT DOCUMENTS

| | | | |
|---|---|---|---|
| 5,409,246 | A | 4/1995 | Ali |
| 5,458,550 | A | 10/1995 | Braim et al. |
| 6,093,024 | A | 7/2000 | Sokolowski |
| 6,178,978 | B1 | 1/2001 | Rieber |
| 8,182,355 | B2 | 5/2012 | Bapst et al. |
| 8,439,765 | B2 | 5/2013 | Barron et al. |
| 8,475,342 | B2 | 7/2013 | Flowers et al. |
| 2010/0317447 | A1 | 12/2010 | Bapst et al. |
| 2011/0009245 | A1 | 1/2011 | Flowers et al. |
| 2012/0084960 | A1 | 4/2012 | Barron et al. |

*Primary Examiner* — Jerome W Donnelly
(74) *Attorney, Agent, or Firm* — Luca D'Ottone; KB Patents

(57) ABSTRACT

The inventive device described in the present application is a combined jumping and walker device. The high of the rope/system is scalable depending on desire length that the user wants it to give the child for a specific purpose—Jump, Walk, Crawl or a combination of any of them. It is emphasized that this abstract is provided to comply with the rules requiring an abstract that will allow a searcher or other reader to quickly ascertain the subject matter of the technical disclosure.

18 Claims, 7 Drawing Sheets

JUMPER 360

BACKGROUND OF THE INVENTION

1. Field of the Invention

The inventive device disclosed in the present application generally relates to motor skills training device for children and more specifically to a device designed to allow the child to jump, walk and crawl or a combination of any of this motor activities.

2. Brief Description of the Prior Art

It is common experience that walking is one of the developmental milestones of a child. Initially children learn to sit, roll over, and crawl before moving on to pulling up and standing at about 9 months. From then on, it's a matter of gaining confidence and balance. Most babies take their first steps sometime between 9 and 12 months and are walking well by the time they're 14 or 15 months old.

A number of devices have been developed to facilitate and implement these steps: these devices are broadly referred as motor skill devices. Motor skills devices are well known in the art. For example, U.S. Pat. No. 5,409,246 to Ali discloses and claims a baby walker that includes a tethering connector to constrain the walker to travel within a path defined by an articulated, telescoping boom, thereby restraining the baby to a range of travel within a predetermined zone of safety. According to Ali's patent, the boom, which is rotatably affixed to a portable weighted base, is selectively angularly and radially limited in its travel relative to the interface of the boom and its point of attachment to the body of the walker. When compared with the JUMPER 360 of the present application the Ali' patent describes a device that does not allow the toddler/user to jump: thus feeling that exciting "gravity free" feeling generated by a jump rather than a walk. Additionally the Ali device does not swing and It is stationary.

In addition to that, U.S. Pat. No. 5,458,550 to Braim et al. discloses and claims a suspendable child walker system that includes a slide bar coupled to an upper support surface and formed as a hollow generally rectangular box. In the Braim et al. walkr the slide bar has a roof and a floor with vertical sidewalls. The roof and floor of the Braim et al. device both have parallel long sides and parallel short sides with circular apertures throughout. When compared with the JUMPER 360 of the present application the Braim et al. patent describes a device that does not allow the toddler/user to walk: thus does not give the opportunity to the toddler/user to develop such an important skill like walking. Additionally the Braim et al. device It is stationary.

U.S. Pat. No. 6,093,024 to Sokolowski also discloses and claims a suspended motor-skill training apparatus comprising a substantially solid and weighty main body member defining in horizontally surrounding relation a hollow central region open for vertical passage there through and sized to permit the legs and pelvis of a trainee to pass therethrough. Under the teachings of Sokolowski's patent, the main body member has left and right forwardly disposed attachment points and a rearwardly disposed attachment point defining a geometric center disposed within the hollow central region, and a center of gravity disposed substantially centrally between and rearwardly of the left and right forwardly disposed attachment points. Strap members connect the attachment points to a suspension mechanism mounted on an elevated support structure. When compared with the JUMPER 360 of the present application the Sokolowski patent describes a device that does not allow the toddler/user to walk: thus does not give the opportunity to the toddler/user to develop such an important skill like walking. It's only a jumping station. Additionally the Sokolowski device It is stationary.

U.S. Pat. No. 6,178,978 to Rieber discloses and claims a children's activity and entertainment enclosure includes a housing a plurality of legs attached to the housing to support the housing at a selected elevation above a support surface and a flexible sheet material covering the housing and at least upper portions of the legs. In the Rieber children's activity and entertainment enclosure a plurality of activity stations are present within the enclosure as are a seat for seating a child and a suspension mechanism for suspending the seat from the housing so that a child sitting in the seat with feet engaging the support surface can maneuver within the enclosure from one activity station to another. When compared with the JUMPER 360 of the present application the Rieber patent describes a device that does not allow the toddler/user to walk: thus does not give the opportunity to the toddler/user to develop such an important skill like walking. It's only a jumping station. Additionally the Rieber device It is stationary.

U.S. Pat. No. 8,182,355 to Bapst et al. discloses and claims an apparatus including a support frame, a resilient member, a seat, and a retainer. The resilient member of the Bapst et al. apparatus has a first end portion configured to be coupled to the support frame and a second end portion, opposite from the first end portion. The seat is configured to be coupled to the second end portion such that the seat is suspended from the support frame by the resilient member. When compared with the JUMPER 360 of the present application the Bapst et al. patent describes a device that does not allow the toddler/user to walk: thus does not give the opportunity to the toddler/user to develop such an important skill like walking. It's only a jumping station. Additionally the Bapst et al. device It is stationary.

U.S. Pat. No. 8,439,765 to Barron discloses and claims, child entertainment apparatus and methods of operating the same are disclosed. An example method of operating a child entertainment apparatus includes suspending a seat from a frame and driving the seat for swinging movement by reciprocating an arm slidably coupled to the seat where the seat is free to slide along the arm when the seat swings. When compared with the JUMPER 360 of the present application the Barron patent describes a device that does not allow the toddler/user to walk: thus does not give the opportunity to the toddler/user to develop such an important skill like walking. It's only a jumping station. Additionally the Barron is stationary.

Finally, U.S. Pat. No. 8,475,342 to Flowers and Flowers discloses and claims a portable child development station. More specifically, an infant crawling and walking aid. The inventive device disclosed by Flowers and Flowers is collapsible and can be stored in smaller confines. When the invention is set up, it is structurally sound and safe with detachable variations allowing assistance in crawling as well as walking by suspending the infant with variable height adjustments to accommodate infant. When compared with the JUMPER 360 of the present application the Flowers patent describes a device that does not allow the toddler/user to jump: thus feeling that exciting "gravity free" feeling generated by a jump rather than a walk. Additionally the Ali device does not swing and It is stationary: thus limiting the movement of the toddler/user.

Despite all the efforts listed above prior art patents describe structures that are either not truly convenient or else involve complicated, expensive, and overly difficult assembly and/or disassembly parts and procedures. The JUMPER 360 has a jumping apparatus combined with a walker component—The high of the rope/system is scalable depending on desire length that the user wants it to give the child/user for a specific purpose- Jump, Walk, Crawl or a combination of any of them. In addition to that the the JUMPER 360 system can be static or dynamic- can move from place to place as well as can go 360 degrees in the top via swing mechanism and/ or 360 degrees Top and Bottom mechanism can be individually lock and can be maintain in one position. on the bottom via the supporting wheels or the bottom ring Top and Bottom mechanism can be individually lock and can be maintain in one position. An additional improvement that distinguishes and improves the JUMPER 360 of the present application over the prior art is the fact that lateral supports and supporting bars disconnect easily via a quick release mechanisms (30-31) located respectively at the bottom (30) of said vertical studs departing from two diametrically opposite spots and in the extreme ends of the top (31) of said vertical studs departing from two diametrically opposite spots. Finally the user can disconnect the the JUMPER 360 device by a quick release mechanism (29) and the install a Swing or another activity device that is supported via the same quick release mechanism or eye hooks located in the sides of the holding bar. These features are not present in prior art patents and patent publications. Other devices have been advertised on various media but never patented or described into a printed publication.

SUMMARY OF THE INVENTION

The inventive device disclosed in the present application is a device that combines a jumping apparatus together with a walker component. The high of the rope/system or another devise/support such as a band, belt, cord etc. is scalable depending on desire length that the user wants it to give the child/user for a specific purpose such as Jump, Walk, Crawl or a combination of any of them. The inventor commonly refers to the combined jumper walker crawler of the present application as the: "JUMPER 360". As it can be inferred from the drawings essential components of the "JUMPER 360" of the present application include but are not limited to: dye cast connections, a spring, a rope/belt/band, a holding bar, a stabilizing bar, a frame, a kid seat, a cushion area, a base support, a set of at least five 360 degree horizontally rotatable wheels, a locking or braking mechanism, a plurality of studs, and a generally circular base member.

In addition to that the the JUMPER 360 system can be static or dynamic—can move from place to place as well as can go 360 degrees in the top via swing mechanism and/ or 360 degrees on the bottom via the supporting wheels or the bottom ring. Finally the user can disconnect the the JUMPER 360 device by a quick release mechanism and the install a Swing or another support via the same quick release mechanism or eye hooks located in the sides of the holding bar. Top and Bottom mechanism can be individually lock and can be maintain in one position. Also it is easily transportable and stored as the base, lateral supports and supporting bar as well as the seating or other activity device disconnect easily via a quick release mechanisms (30-31) located respectively at the bottom (30) of said vertical studs departing from two diametrically opposite spots and in the extreme ends of the top (31) of said vertical studs departing from two diametrically opposite spots . The J-360 have bumpers (33) or equivalent shock absorbing mechanism around the outside surface of said annular base element for protecting against bumping around the wall as the kids jump and walk around.

It is then the principal object of the present invention is to provide for a device that allows kids in their developmental stage to practice walking and crawling and gain self confidence without fear of falling face first. It is a secondary objective of the present invention to provide a device that allows newborns and toddlers to experience the feeling of jumping aroundAlso allowed the toddles to crawl, walk and /or jump and any combination of these activities at the same time and with ease and safety. The J-360 Allows for quick adjustment of distance from devise to floor for quick change of activity been, crawling, walking or Jumping or any combination of these activities.

It is an additional objective of the present invention to provide a device that generally protect kids by keeping them busy and happy in practicing a fun activity on a safe structure. It is a final objective of the present invention to provide for a device that is relatively inexpensive and easy to build and set up and disassemble for easy storage and transportation, but can eventually be sold at a premium.

These and other objective achieved by the device of the present invention will be apparent by the drawings, by their detailed description, by the specification, and by the claims here from appended.

DESCRIPTION OF THE PREFERRED EMBODIMENT

Figure 1:
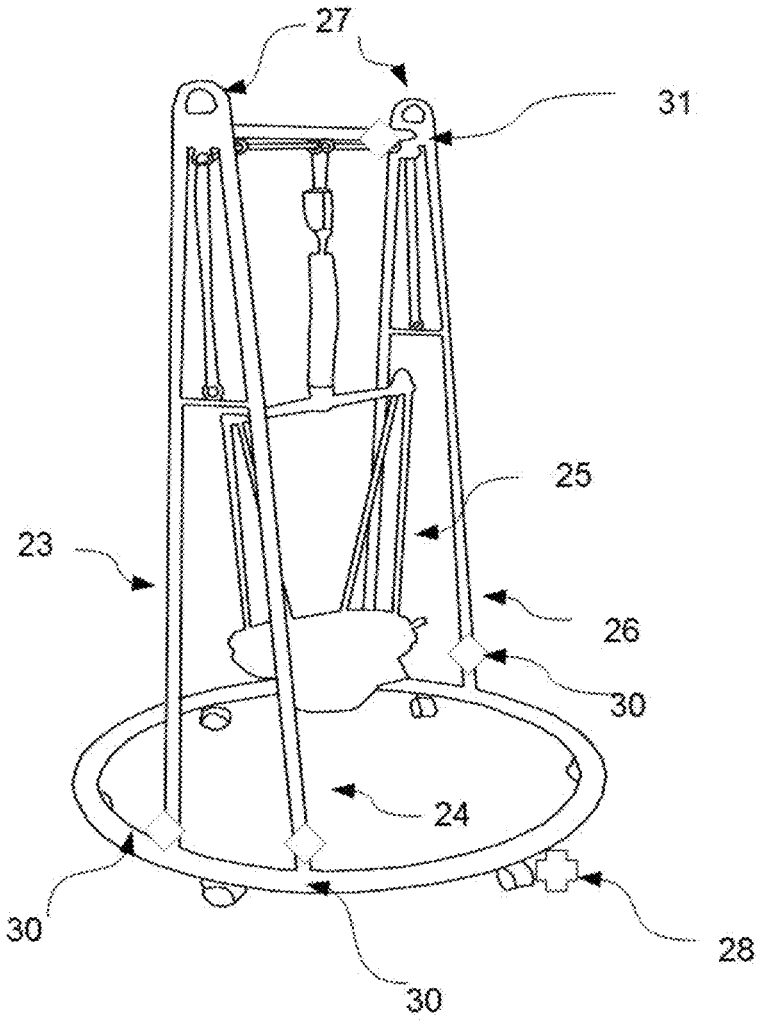
FIG. 1 is a first perspective view of one of the preferred embodiments of the "JUMPER 360" in accordance with the teaching of the present invention.
Figure 2:
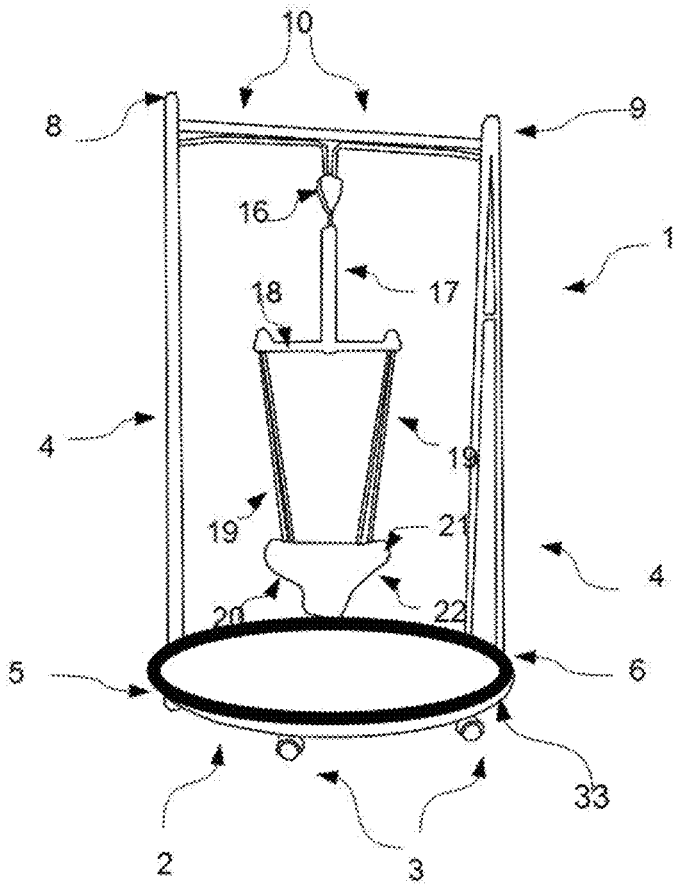
FIG. 2 is a second front perspective view of "JUMPER 360" of FIG. 1 and all its features.
Figure 3:
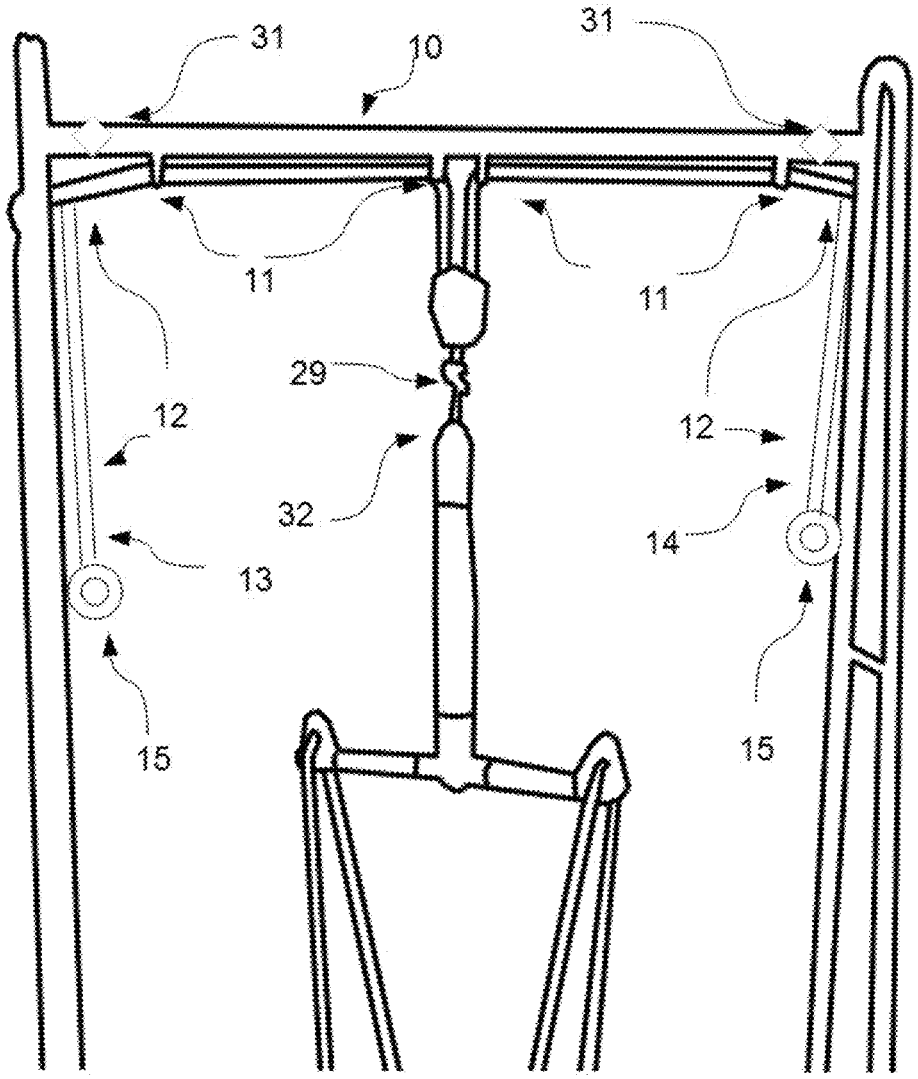
FIG. 3 is a detailed front perspective view of the top portion of the "JUMPER 360" of FIG. 1.

The inventive device disclosed in the present application is a device that combines a jumping apparatus together with a walker component. The high of the rope/system is scalable depending on desire length that the user wants it to give the child/user for a specific purpose such as Jump, Walk, Crawl or a combination of any of them. This can also be achieve by a belt, band or any other ready available systems in the marketplace. The inventor commonly refers to the combined jumper walker crawler of the present application as the: "JUMPER 360". As it can be inferred from the drawings essential components of the "JUMPER 360" of the present application include but are not limited to: dye cast connections, a spring, a rope/belt/band a holding bar, a stabilizing bar, a frame, a kid seat, a cushion area, a base support, a set of at least five 360 degree horizontally rotatable wheels, a locking or braking mechanism, a plurality of studs, and a generally circular base member.

This system can be static or dynamic- can move from place to place as well as can go 360 degrees in the top via swing mechanism and/ or 360 degrees on the bottom via the supporting wheels or the bottom ring. The Jumper/Walker device can be disconnected by a quick release mechanism and the install a Swing or another devices via the same quick release mechanism or eye hooks located in the sides of the holding bar. Locks make it stationary on top and bottom.

In one of its preferred embodiments the motor skill device (1) designed to facilitate the development of a toddler motor skill while entertaining of the present application comprises at least: a annular elliptical base element (2) mounted on a plurality of horizontally rotatable wheels (3); where said annular elliptical base element supports a plurality of vertical studs (4) departing from two diametrically opposite spots (5; 6) joined on their upper endings (8;9) via a connector (10) having a plurality of hooks (11) holding a rope (12); said rope a band, an elastic band, a belt and any other similar supports/holders having two endings a first ending (13) and a second ending (14) respectively attached to rope adjustment rings (15) mounted on the opposite studs (5; 6); said rope being connected via a junction (16) to a jumping mechanism (17) holding a stabilizing bar (18) ultimately connected via a plurality of secondary holding ropes (19) to a toddler seat (20) comprising at least a circular frame (21) holding a seating cushion (22). In a separate preferred embodiment of said motor skill device designed to facilitate the development of a toddler motor skill while entertaining it annular elliptical base describes a circular annulus. An annulus is a ring-shaped object, especially a region bounded by two concentric circles. The adjectival form is annular (as in annular eclipse).

With respect to the plurality of horizontally rotatable wheels ergonomic principles dictate that at least five wheels are necessary for proper support. Horizontally rotatable means that the week may assume any orientation on the horizontal plane due to a ball bearing mechanism that keeps them connected to said elliptical annular base, such as casters. Said wheels may have at least one brake lock (28) to ensure that the whole device does not freely slides. In various preferred embodiments of the he motor skill device designed to facilitate the development of a toddler motor skill while entertaining it of the present application said jumping mechanism may either be a mechanical coil spring, a helical spring, or an elastic band. In a separate preferred embodiment of the device of the present application said mechanical coil spring is combined with a bearing system (32) that allows for a full 360 degree rotation on the horizontal plane.

Figure 4:
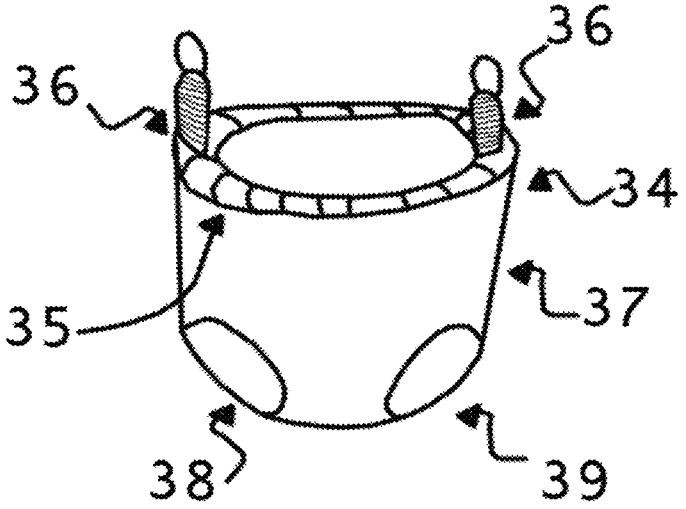
FIG. 4 is a view of the swinging seat under the teachings of the present invention.

The plurality of vertical studs consist in four generally vertical studs (23, 24, 25, 26) arranged in two sets of two studs each departing from two diametrically opposite spots (5, 6) annular elliptical base element where each pair is joined by a semi circular die cast metal junction (27) on its top. Die casting is a metal casting process that is characterized by forcing molten metal under high pressure into a mould cavity. The mold cavity is created using two hardened tool steel dies which have been machined into shape and work similarly to an injection mold during the process. The die casting is necessary to avoid fractures and in general weakness in the component. A quick release mechanism (29) in between said plurality of hooks (11) and said jumping mechanism (17) allows for quick exchange of the jumping device that can be easily converted into different entertaining devices such as a swing, a walker, a crawler, and the like. This is done by substituting said jumping mechanism respectively with a swing seat, with a walker seat, and or with a crawler seat. For the purpose of the present application a swinging is just a regular seat (34) shown in FIG. 4, including a generally elliptical base member (35) held in place by two hooks, quicklink, or other connecting means, holding a structure (37) generally made of fabric designed to host the toddler featuring at least two openings (38; 39) for the legs.

Figure 5:
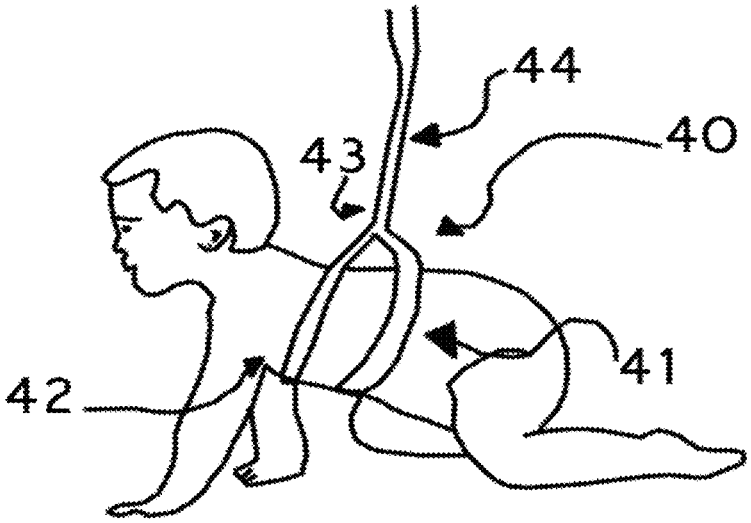
FIG. 5 is a view of the crawling seat under the teachings of the present invention.

A crawler seat (40) as shown in FIG. 5 helps the baby to crawl and is generally constituted by a plurality of bands (41; 42) connected into junction (43) to a holding rope (44).

Figure 6:
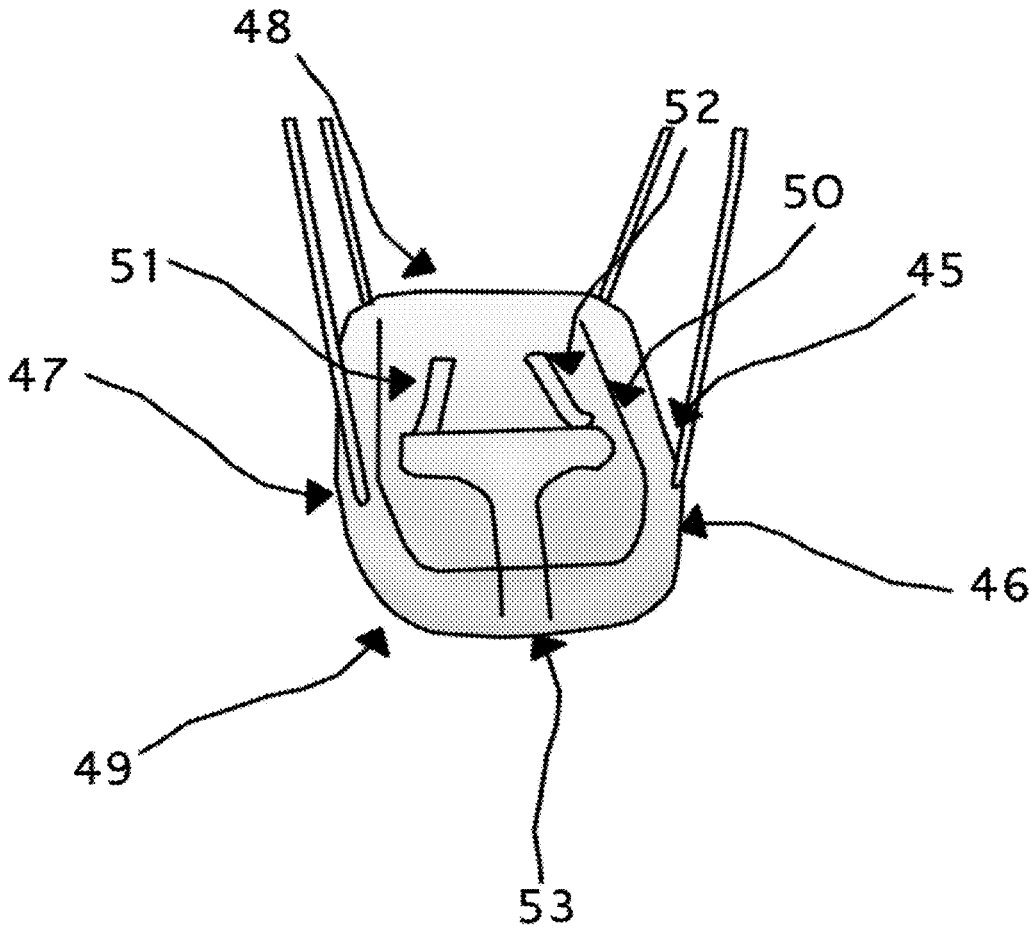
FIG. 6 is a view of the toddler seat under the teachings of the present invention.
Figure 7:
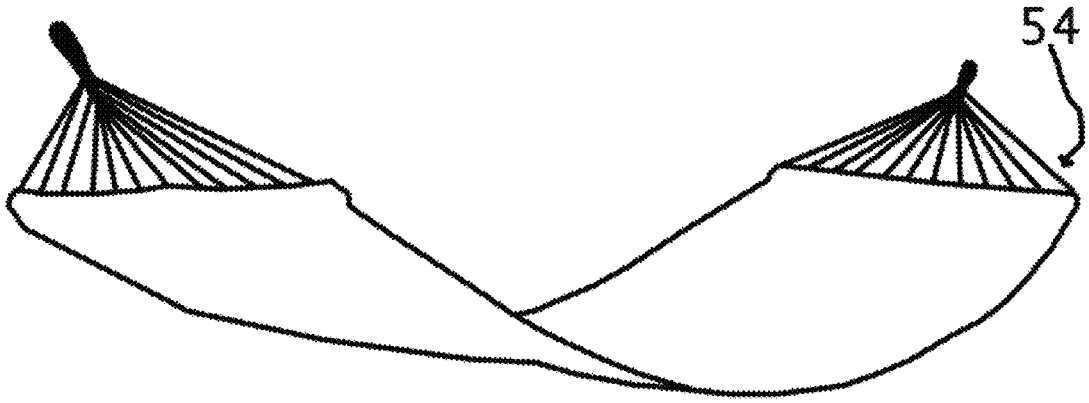
FIG. 7 is a view of the hammock seat (54) more appropriate for kids of older age under the teachings of the present invention.

Ad shown in FIG. 6 a toddler or kid's seat is a seat (45) including harmrest (46; 47) a back support (48) a chair support (49) and a locking mechanism (50) designed to keep the toddler in place that may include strapping bands (51; 52) and a pivotal locking mechanism (53). The "JUMPER 360" of the present application can also be equipped with an hammock seat (54) as shown in FIG. 7, more appropriate for kids of older age.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A motor skill device designed to facilitate the development of a toddler motor skill while entertaining it comprising: an annular elliptical base element mounted on a plurality of horizontally rotatable wheels; where said annular elliptical base element supports a plurality of vertical studs departing from two diametrically opposite spots joined on their upper endings via a connector having a plurality of hooks holding a rope; said rope having two endings a first and a second ending respectively attached to rope adjustment rings mounted on the opposite studs; said rope being connected via a junction to a jumping mechanism holding a stabilizing bar ultimately connected via a plurality of secondary holding ropes to a toddler seat comprising at least a circular frame holding a seating cushion.

2. The motor skill device designed to facilitate the development of a toddler motor skill while entertaining it of claim 1 where said annular elliptical base describes a circular annulus.

3. The motor skill device designed to facilitate the development of a toddler motor skill while entertaining it of claim 1 where said plurality of horizontally rotatable wheels is at least five wheels.

4. The motor skill device designed to facilitate the development of a toddler motor skill while entertaining it of claim 1 where said jumping mechanism is a mechanical coil spring.

5. The motor skill device designed to facilitate the development of a toddler motor skill while entertaining it of claim 4 where said jumping mechanism comprises a mechanical coil spring supported by a bearing system.

6. The motor skill device designed to facilitate the development of a toddler motor skill while entertaining it of claim 1 where said jumping mechanism is a helical spring.

7. The motor skill device designed to facilitate the development of a toddler motor skill while entertaining it of claim 1 where said jumping mechanism is an elastic band.

8. The motor skill device designed to facilitate the development of a toddler motor skill while entertaining it of claim 1 where said plurality of vertical studs consist in four generally vertical studs arranged in two sets of two studs each departing from two diametrically opposite spots annular elliptical base element where each pair is joined by a semi circular dye cast metal junction on its top.

9. The motor skill device designed to facilitate the development of a toddler motor skill while entertaining it of claim 1 where said plurality of horizontally rotatable wheels has at least one brake lock.

10. The motor skill device designed to facilitate the development of a toddler motor skill while entertaining it of claim 1 further comprising a quick release mechanism in between said plurality of hooks and said jumping mechanism.

11. The motor skill device designed to facilitate the development of a toddler motor skill while entertaining it of claim 1 where said toddler seat is selected from the group consisting of a swing seat, a jumping seat, and a crawler seat.

12. The motor skill device designed to facilitate the development of a toddler motor skill while entertaining it of claim 1 where said toddler seat is a walker seat.

13. The motor skill device designed to facilitate the development of a toddler motor skill while entertaining it of claim 1 further comprising a quick release mechanisms located at the bottom of said vertical studs departing from two diametrically opposite spots.

14. The motor skill device designed to facilitate the development of a toddler motor skill while entertaining it of claim 1 further comprising a quick release mechanisms located at the top of said vertical studs departing from two diametrically opposite spots.

15. The motor skill device designed to facilitate the development of a toddler motor skill while entertaining it of claim 1 further comprising shock absorbing mechanism around. the outside surface of said annular elliptical base element.

16. The motor skill device designed to facilitate the development of a toddler motor skill while entertaining it of claim 1 where said rope is a belt.

17. The motor skill device designed to facilitate the development of a toddler motor skill while entertaining it of claim 1 where said rope is a band.

18. The motor skill device designed to facilitate the development of a toddler motor skill while entertaining it of claim 17 where said band is a elastic.

* * * * *